US010490918B2

(12) United States Patent
Chen

(10) Patent No.: US 10,490,918 B2
(45) Date of Patent: Nov. 26, 2019

(54) FIXING ASSEMBLY OF CABLE CONNECTOR AND FLEX FLAT CABLE

(71) Applicant: Ying Hao Technology CO., LTD., New Taipei (TW)

(72) Inventor: Chih-Jung Chen, New Taipei (TW)

(73) Assignee: YING HAO TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/111,771

(22) Filed: Aug. 24, 2018

(65) Prior Publication Data

US 2019/0067850 A1 Feb. 28, 2019

(30) Foreign Application Priority Data

Aug. 25, 2017 (TW) ..... 106212663 U

(51) Int. Cl.

| | |
|---|---|
| ***H01R 12/70*** | (2011.01) |
| ***H01R 12/62*** | (2011.01) |
| ***H01R 13/193*** | (2006.01) |
| ***H01R 12/72*** | (2011.01) |
| ***H01R 31/06*** | (2006.01) |
| *H01R 12/77* | (2011.01) |
| *H01R 12/79* | (2011.01) |

(52) U.S. Cl.

CPC ..... *H01R 12/7082* (2013.01); *H01R 12/62* (2013.01); *H01R 12/7023* (2013.01); *H01R 12/72* (2013.01); *H01R 13/193* (2013.01); *H01R 31/06* (2013.01); *H01R 12/721* (2013.01); *H01R 12/778* (2013.01); *H01R 12/79* (2013.01)

(58) Field of Classification Search

CPC ..... H01R 12/7082

See application file for complete search history.

(56) References Cited

U.S. PATENT DOCUMENTS

| | | | | |
|---|---|---|---|---|
| 6,299,476 | B1 * | 10/2001 | Schramme | H01R 12/774 439/492 |
| 7,074,074 | B2 * | 7/2006 | Zhang | H01R 12/771 439/260 |
| 7,530,839 | B1 * | 5/2009 | Lee | H01R 12/592 439/496 |
| 8,192,219 | B2 * | 6/2012 | Satoh | H01R 12/79 439/328 |
| 8,242,374 | B2 * | 8/2012 | Chuo | H05K 1/118 174/250 |
| 8,292,648 | B2 * | 10/2012 | Kiryu | H01R 13/6271 439/328 |
| 8,529,286 | B2 * | 9/2013 | Su | H01R 13/506 439/495 |
| 9,065,200 | B2 * | 6/2015 | Kim | H01R 12/772 |
| 9,070,993 | B2 * | 6/2015 | Honda | H01R 12/88 |
| 10,193,254 | B2 * | 1/2019 | Katano | H01R 12/774 |
| 2003/0203680 | A1 * | 10/2003 | Boutros | H01R 12/774 439/660 |
| 2010/0190373 | A1 * | 7/2010 | Yeh | H01R 12/592 439/499 |

* cited by examiner

*Primary Examiner* — Ross N Gushi

(74) *Attorney, Agent, or Firm* — Muncy, Geissler, Olds & Lowe, P.C.

(57) ABSTRACT

A fixing assembly of a cable connector and a flexible cable is provided. The flexible cable includes a plurality of conductors. The cable connector includes a shell, a plurality of terminals arranged in the shell, and a push-pull device configured to activate the flexible cable to move toward the plurality of terminals so as to conduct the plurality of terminals through the plurality of conductors of the flexible cable.

5 Claims, 11 Drawing Sheets

FIXING ASSEMBLY OF CABLE CONNECTOR AND FLEX FLAT CABLE

BACKGROUND

1. Field of the Disclosure

The present disclosure relates to a fixing assembly of a cable connector and a flex flat cable, and more particularly, to a removable fixing assembly of a cable connector and a flex flat cable.

2. Description of the Related Art

A flat cable is a data conducting cable configured to transfer data between two electronic devices. Generally, a flat cable is formed by a plurality of wires arranged in parallel, and each of the plurality of wires is covered with an insulating layer and configured to transmit signals independently. A flex flat cable (FFC) or a flex cable is a new kind of data cable fabricated from insulating material and extremely thin tinned flat copper wire after being compressed with automation equipment. The FFC or the flex cable has advantages of neat arrangement of the core, large transmission volume, flat structure, compact size, easy disassembly, and flexibility and can be easily and flexibly applied to various electronic products as a data conducting cable. The FFC is especially suitable for a variety of high frequency bending applications, such as connection of moving components. As for connection, the FFC can be soldered directly onto a printed circuit board (PCB) of a connector so that signals can be transmitted through the FFC to other devices.

However, if the FFC is soldered to the PCB of the connector, the application of the FFC is greatly limited. For example, when the length of the FFC is insufficient and needs to be replaced, it cannot be easily replaced with a longer FFC. Moreover, if the connector is connected to an electronic device, it is usually necessary to fix the PCB on a base to form a connector. So one more procedure is required in the manufacturing process, and one more component is required.

In addition, the FFC often bends or twists as the device moves. Multiple movements or insertion and removal may cause the portion where the FFC and the PCB are soldered or connected to get loose, resulting in poor signal quality or even short circuit. Therefore, how to effectively and firmly connect the FFC to the cable connector with convenience becomes an issue to such a fixing assembly of a cable connector and a flex flat cable.

SUMMARY

In view of this, it is necessary to propose a fixing assembly of a cable connector and a flexible cable to solve the problem of connecting a flex flat cable of the related art to a connector or a circuit board.

According to a first aspect of the present disclosure, a fixing assembly of a cable connector and a flexible cable is provided. The flexible cable includes a plurality of conductors. The cable connector includes a shell, a plurality of terminals arranged in the shell, and a push-pull device configured to activate the flexible cable to move toward the plurality of terminals so as to conduct the plurality of terminals through the plurality of conductors of the flexible cable.

According to one embodiment, the flexible cable is arranged on the push-pull device.

According to one embodiment, the cable connector further comprises a circuit board. The circuit board comprises a plurality of conductive parts. The plurality of conductive parts contact the plurality of conductors of the flexible cable.

According to one embodiment, the push-pull device is assembled onto the circuit board and configured to activate the flexible cable to move toward the plurality of terminals so as to contact the plurality of terminals to the plurality of conductors of the flexible cable.

According to one embodiment, the plurality of conductive parts are soldered to the plurality of conductors of the flexible cable.

According to one embodiment, the fixing assembly comprises an insulating adhesive. The insulating adhesive covers a connecting portion of the plurality of conductors and the plurality of conductive parts.

According to one embodiment, the fixing assembly further comprises a protective cover; the protective cover covers the circuit board, the plurality of conductors, and the insulating adhesive.

According to one embodiment, the push-pull device comprises a protrusive portion. The push-pull device is configured to impose force on the protrusive portion to activate the flexible cable to move toward the plurality of terminals or to impose force on the protrusive portion to activate the flexible cable to move away from the plurality of terminals into another direction.

According to one embodiment, the push-pull device comprises an engaged component. The shell comprises a first embedded component. The engaged component of the push-pull device is embedded into the first embedded component after the push-pull device activates the flexible cable to move toward the plurality of terminals.

According to one embodiment, the shell further comprises a second embedded component; the first embedded component is closer to the plurality of terminals than the second embedded component. The engaged component of the push-pull device is embedded into the second embedded component after the push-pull device activates the flexible cable to move away from the plurality of terminals into another direction.

According to one embodiment, the fixing assembly comprises a first insulating adhesive that covers a connecting portion of the plurality of conductors and the plurality of conductive parts.

According to one embodiment, the fixing assembly further comprises a protective cover that covers the circuit board, the plurality of conductors, and the first insulating adhesive.

According to a second aspect of the present disclosure, a fixing assembly of a cable connector and a flexible cable is provided. The flexible cable includes a plurality of conductors. The cable connector includes a shell, a plurality of terminals arranged in the shell, and a compressing device configured to compress the flexible cable so as to contact the plurality of conductors and the plurality of terminals tightly.

According to one embodiment, the flexible cable comprises an insulating coat. The compressing device is arranged in the insulating coat. The insulating coat comprises a protrusive plate. The compressing device is configured to impose force on the protrusive plate to activate the flexible cable to move toward the plurality of terminals or to impose force on the protrusive plate to activate the flexible cable to move away from the plurality of terminals into another direction.

According to one embodiment, the compressing device comprises an engaged bump. The shell comprises a first embedded component. The engaged bump of the compressing device is embedded into the first embedded component after the compressing device moves towards the plurality of terminals.

According to one embodiment, the shell further comprises a second embedded component; the first embedded component is closer to the plurality of terminals than the second embedded component. The engaged bump of the compressing device is embedded into the second embedded component after the compressing device activates the flexible cable to move away from the plurality of terminals into another direction.

According to one embodiment, the compressing device acts as a bending portion of the shell. The bending portion is formed after the shell bends inward to form a compressing side to compress the flexible cable.

According to a third aspect of the present disclosure, a fixing assembly of a cable connector and a flexible cable is provided. The flexible cable includes a plurality of conductors. The cable connector includes a shell, a circuit board comprising a plurality of conductive parts, and a plurality of terminals arranged in the shell and contacting the plurality of conductive parts. The plurality of conductive parts are soldered to the plurality of conductors.

According to one embodiment, the fixing assembly comprises an insulating adhesive. The insulating adhesive covers a connecting portion of the plurality of conductors and the plurality of conductive parts.

According to one embodiment, the fixing assembly further comprises a protective cover that covers the circuit board, the plurality of conductors, and the insulating adhesive.

According to one embodiment, the circuit board comprises an engaged component; the shell comprises a first embedded component. The engaged component of the circuit board is embedded into the first embedded component after the circuit board moves towards the plurality of terminals.

According to one embodiment, the shell further comprises a second embedded component. The first embedded component is closer to the plurality of terminals than the second embedded component. The engaged component of the circuit board is embedded into the second embedded component after the circuit board moves away from the plurality of terminals into another direction.

According to one embodiment, the cable connector comprises an insulating adhesive filled up an area between the shell and the flexible cable. The insulating adhesive is arranged on the other side of connection of the plurality of conductors and the plurality of terminals so as to connect the plurality of conductors to the plurality of terminals firmly.

According to a fourth aspect of the present disclosure, a fixing assembly of a cable connector and a flexible cable is provided. The flexible cable includes a plurality of conductors. The cable connector includes a shell, a plurality of terminals arranged in the shell and soldered to the plurality of conductors.

According to one embodiment, the fixing assembly comprises an insulating adhesive covering a connecting portion of the plurality of conductors and the plurality of terminals.

The fixing assembly of the cable connector and the flexible cable of the present disclosure simplifies assembly steps and reduces material cost compared with a fixing assembly of a cable connector and a flexible cable of the related art. The FFC of the present disclosure is removable so it can be inserted or removed according to requirements. Also, the flexible cable can be easily replaced while being firmly connected with the cable connector, which will not be easily loosed or removed because of shaking.

These and other objectives of the claimed invention will no doubt become obvious to those of ordinary skill in the art after reading the following detailed description of the preferred embodiment that is illustrated in the various figures and drawings.

BRIEF DESCRIPTION OF THE DRAWINGS

FIG. 15A is a diagram illustrating an assembly of the terminal and the circuit board illustrated in FIG. 14.

FIG. 15B is a diagram illustrating a separation of the terminal and the circuit board illustrated in FIG. 14.

DETAILED DESCRIPTION OF THE EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 1:
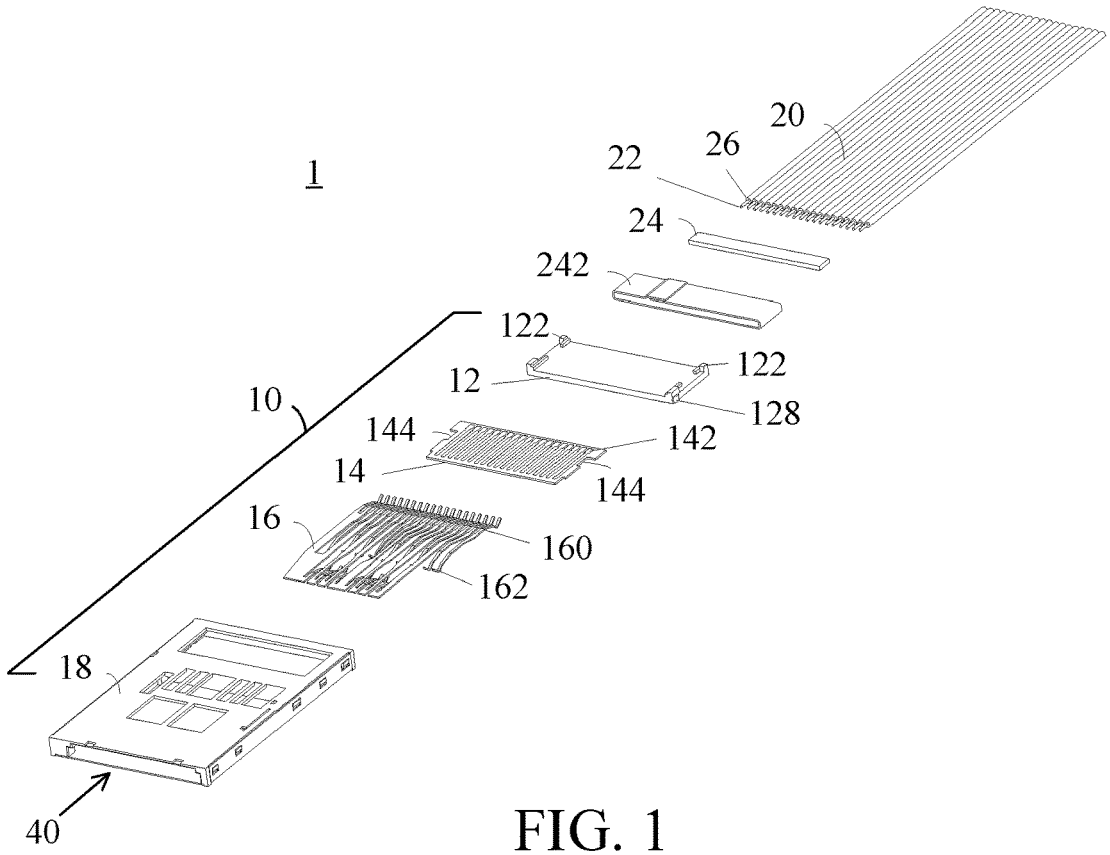
FIG. 1 illustrates an exploded diagram of a fixing assembly of a cable connector and a flexible cable according to a first embodiment of the present disclosure.

Please refer to FIG. 1 illustrating an exploded diagram of a fixing assembly 1 of a cable connector 10 and a flexible cable 20 according to a first embodiment of the present disclosure. The fixing assembly 1 is configured for an electronic device such as a desktop computer, a notebook computer, a tablet computer, etc. The fixing assembly 1 includes a cable connector 10 and a flexible cable 20. The cable connector 10 can be configured to insert an electronic memory card (not illustrated), such as a cable connector that conforms to the specifications of a secure digital (SD) card. The SD card includes standard SD, MicroSD, MiniSD, SDHC, and so on The SD card is inserted from a direction 40 toward the cable connector 10. The flexible cable 20 is inserted in the cable connector 10 so that the electronic device can access the data stored in the electronic memory card through the flexible cable 20 and the cable connector 10. The flexible cable 20 proposed by the present disclosure may be a standard flex cable or a flexible flat cable (FFC).

The cable connector 10 includes a push-pull device 12, a circuit board 14, a plurality of terminals 16, and a shell 18. The push-pull device 12 includes a protrusive portion 122 thereon. The circuit board 14 includes a first accommodating space 144. The protrusive portion 122 is sized to match the size of the first accommodating space 144. The protrusive portion 122 and the first accommodating space 144 are fixed firmly, and the circuit board 14 is disposed on the push-pull device 12. The circuit board 14 further includes a plurality of conductive parts 142. The terminal 16 includes a connecting portion 160 and a terminal portion 162. The connecting portion 160 is connected to the plurality of conductive parts 142. The terminal portion 162 is configured to connect with a component like an SD card that conforms to the specifications of the terminal 16.

Figure 2:
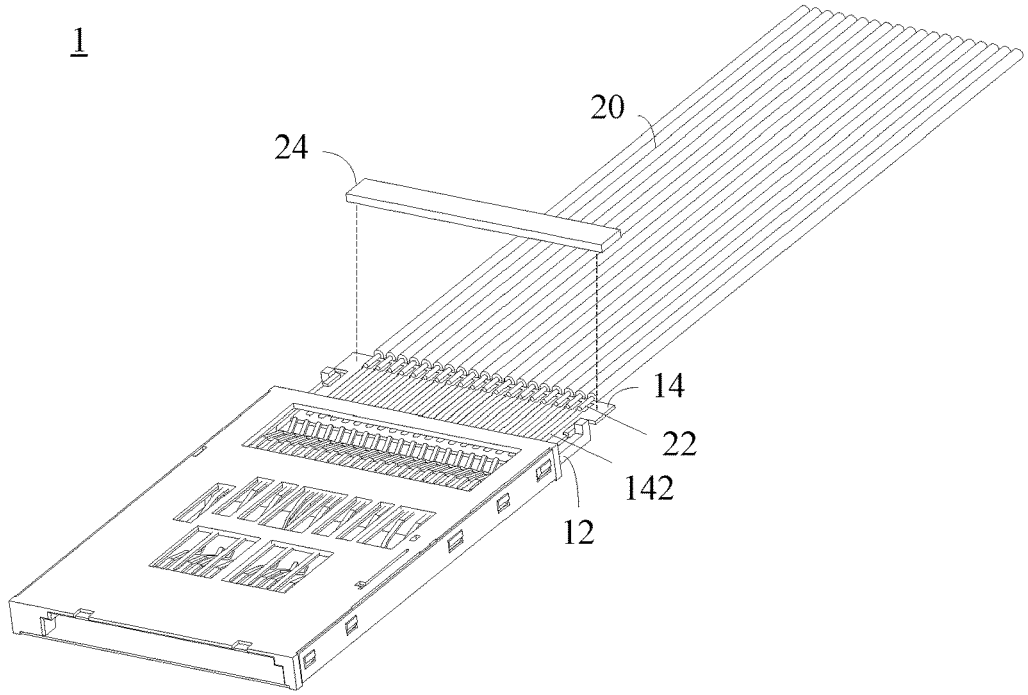
FIG. 2 is a stereogram of the cable connector in FIG. 1 assembled with the flexible cable.

Please refer to FIG. 2 as well. FIG. 2 is a stereogram of the cable connector 10 in FIG. 1 assembled with the flexible cable 20. The flexible cable 20 includes a plurality of conductors 22. Each of the plurality of conductors 22 is separated by an insulating coat 26. The flexible cable 20 and the circuit board 14 are electrically connected. Part of the conductor 22 exposed outside the insulating coat 26 is connected to the conductive part 142 on the circuit board 14. The fixing assembly 1 further includes a first insulating adhesive 24 to protect an area where the conductor 22 is connected to the circuit board 14. In the present embodiment, the conductor 22 is firmly soldered on the circuit board 14. In particular, the conductor 22 is soldered in a HotBar soldering method. The HotBar soldering method is of paving a solder paste on the circuit board 14 and then compressing the flexible cable 20 on the circuit board 14 with a hot presser while at the same time, melting the solder paste on the circuit board 14 to solder the flexible cable 20 on the circuit board 14. The flexible cable 20 is connected to the circuit board 14 only via soldering so the connecting area of the plurality of conductors 22 and the plurality of conductive parts 142 is covered with the first insulating adhesive 24 to protect the soldered portion while the conductor 22 is firmly fixed on the circuit board 14. Mounted on the circuit board 14, the connection of the conductor 22 to the conductive part 142 is reinforced. In addition, for a protective cover 242, the protective cover 242 can simultaneously cover the push-pull device 12, the conductor 22, and a first insulating adhesive 24. In this way, the conductor 22 is more fixed to the cable connector 10 to avoid shaking or moving. The conductor 22 may poorly contact the conductive part 142 and further affect the quality of the transmitted signal due to shaking or moving.

Figure 3:
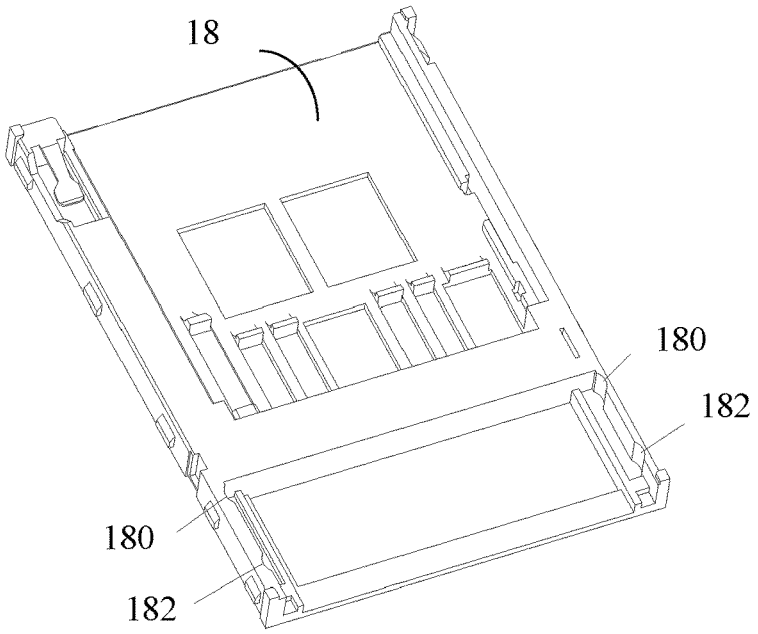
FIG. 3 illustrates the internal structure of the shell of FIG. 1.

Please refer to FIG. 3 illustrating the internal structure of the shell 18 of FIG. 1. The shell 18 includes a first embedded component 180 and a second embedded component 182. The push-pull device 12 includes a first engaged component 128. The shape and size of the first engaged component 128 matches the first embedded component 180 and the second embedded component 182 so that the first engaged component 128 can be fixed to the first embedded component 180 to fix the push-pull device 12 to the shell 18. The first engaged component 128 can be fixed to the second embedded component 182 as well to fix the push-pull device 12 to the shell 18.

Figure 4A:
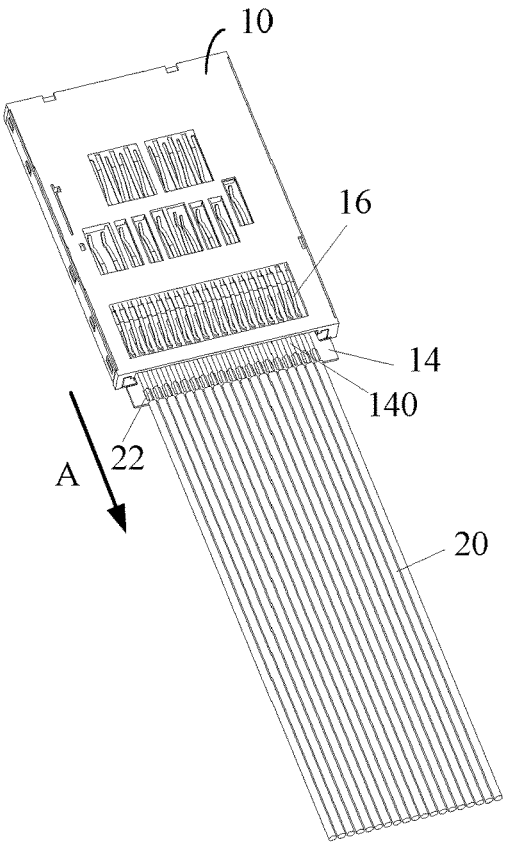
FIG. 4A is a diagram illustrating an assembly of the flexible cable and the cable connector according to the first embodiment of the present disclosure.
Figure 4B:
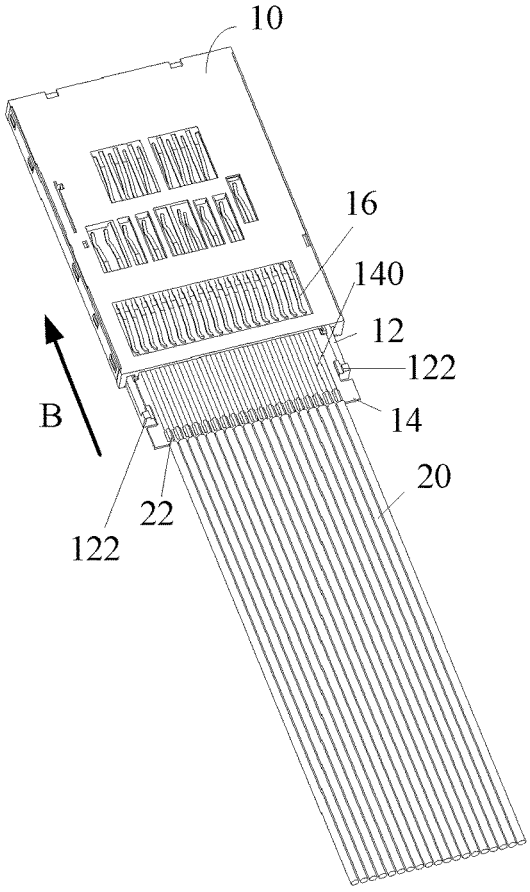
FIG. 4B is a diagram illustrating a separation of the flexible cable and the cable connector according to the first embodiment of the present disclosure.
Figure 5A:
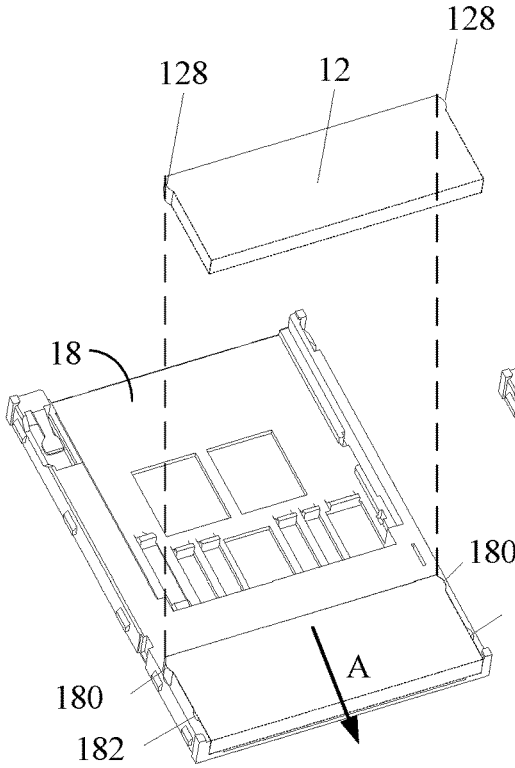
FIG. 5A and FIG. 5B illustrate the relative positions of the first engaged component and the shell corresponding to their state in FIG. 4A and in FIG. 4B, respectively.
Figure 5B:
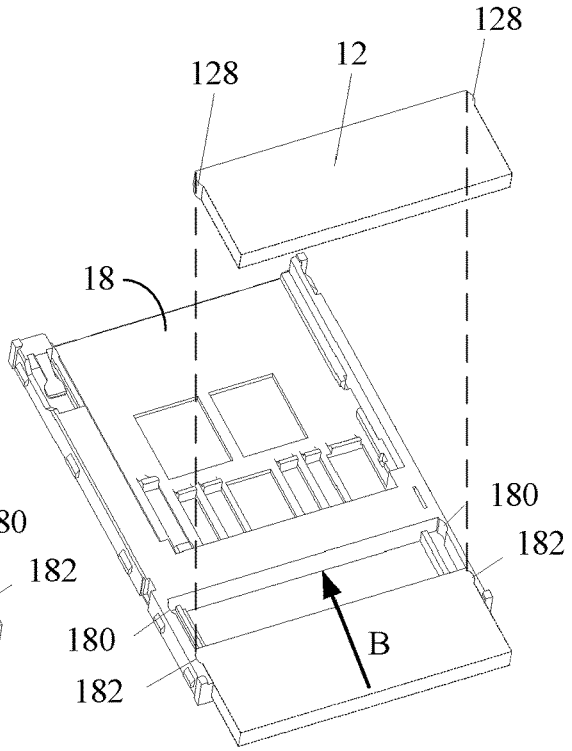

Please refer to FIGS. 4A-4B and FIGS. 5A-5B. FIG. 4A and FIG. 4B are schematic diagrams illustrating the assembly of the flexible cable 20 and the cable connector 10 and the separation of the flexible cable 20 and the cable connector 10, respectively, according to the first embodiment of the present disclosure. FIG. 5A and FIG. 5B illustrate the relative positions of the first engaged component 128 and the shell 18 corresponding to their state in FIG. 4A and in FIG. 4B, respectively. The push-pull device 12 can be moved back and forth relative to the shell 18. In detail, when the first engaged component 128 is fixed to the first embedded component 180, the push-pull device 12 is assembled in the shell 18. The circuit board 14 is connected to the terminal 16 through the conductive part 140. When force is imposed on the protrusive portion 122 to cause the push-pull device 12 to be withdrawn in an A direction, the push-pull device 12 is partially arranged outside the shell 18, and the first engaged component 128 is fixed to the second embedded component 182. At this time, the conductive part 140 is separated from the terminal 16 so that the flexible cable 20 cannot be electrically connected to the terminal 16. Thereafter, force is imposed on the protrusive portion 122 to push the push-pull device 12 into the shell 18 along a B direction. Meanwhile, the first engaged component 128 is fixed to the first embedded component 180, and the conductive part 140 is in contact with the terminal 16. Therefore, the flexible cable 20 can be electrically connected to the terminal 16. The cable connector 10 of the present embodiment is connected in a snapping method, so that the push-pull device 12 and the circuit board 14 arranged thereon can be pushed in or pushed out according to user's needs so as to place or solder the flexible cable 20 or replace the flexible cable 20. It is even possible to withdraw the push-pull device 12, the circuit board 14, and the flexible cable 20 completely with another push-pull device 12, another circuit board 14, and another flexible cable 20 for substitution. Therefore, compared with the cable connector of the related art, a removable FFC is introduced in the first embodiment of the present disclosure. With the fixing assembly 1 of the present embodiment, the users can insert the flexible cable 20 more flexibly.

In the present embodiment, the first engaged component 128 is a bump arranged on the push-pull device 12. The first embedded component 180 and the second embedded component 182 are arranged on the shell 18. The first embedded component 180 and the second embedded component 182 are grooves embedded with the first engaged component 128. In another embodiment, a first engaged component 128 may be a groove arranged on the push-pull device 12. A first embedded component 180 and a second embedded component 182 may be bumps arranged on a shell 18 and embedded with the first engaged component 128. The first engaged component 128 is a semi-circular bump, and the first embedded component 180 and the second embedded component 182 both are semi-circular grooves in the present embodiment. The shape of the first engaged component 128 can be adjusted as needed, for example, rectangular or semi-elliptical.

Figure 6:
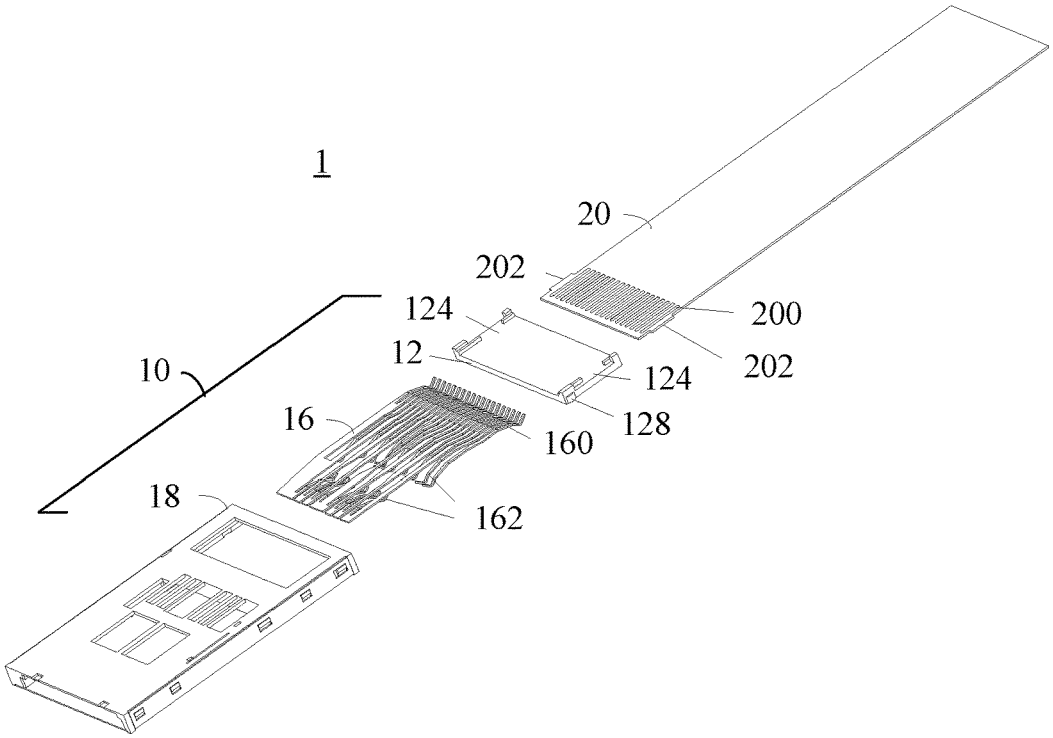
FIG. 6 is an exploded diagram illustrating a fixing assembly of a cable connector and a flexible cable according to a second embodiment of the present disclosure.

FIG. 6 is an exploded diagram illustrating a fixing assembly 1 of a cable connector and a flexible cable according to a second embodiment of the present disclosure. The cable connector 10 includes a push-pull device 12, a terminal 16, and a shell 18. The cable connector 10 is configured to connect with a flexible flat cable (FFC) 20. A secure digital (SD) card is inserted from the direction 40 toward the cable connector 10. A terminal 16 includes a connecting portion 160 and a terminal portion 162 and is fixed in the shell 18. Different from the first embodiment, the cable connector 10 proposed in the second embodiment is not equipped with a circuit board, but a plurality of conductors 200 are disposed on the flexible cable 20, and the connecting portion 160 of the terminal 16 is directly electrically connected to the plurality of conductors 200. To achieve the purpose, a push-pull device 12 includes a second accommodating space 124 thereon. The flexible cable 20 includes a protrusive structure 202 thereon. The shape and size of the protrusive structure 202 are consistent with the second accommodating space 124, so the flexible cable 20 can be fixed on the push-pull device 12.

Figure 7A:
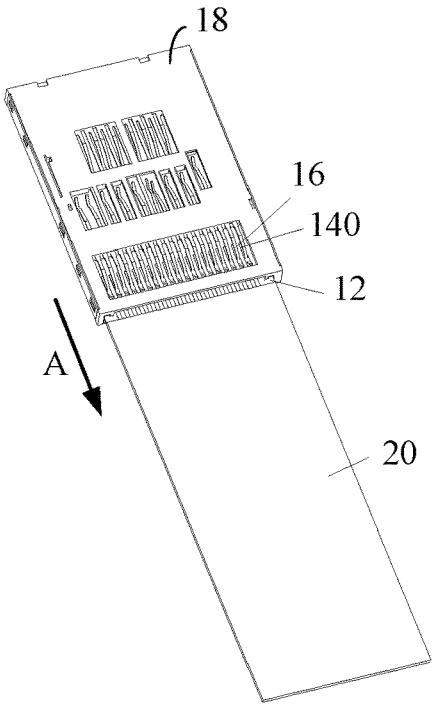
FIG. 7A is a diagram illustrating an assembly of the flexible cable and the cable connector according to the second embodiment of the present disclosure.
Figure 7B:
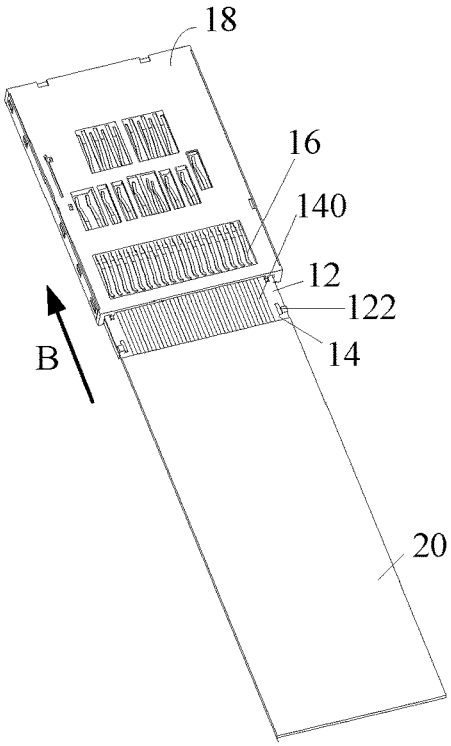
FIG. 7B is a diagram illustrating a separation of the flexible cable and the cable connector according to the second embodiment of the present disclosure.

Please refer to FIG. 5, FIG. 7A, and FIG. 7B. FIG. 7A and FIG. 7B are schematic diagrams illustrating the assembly of the flexible cable 20 and the cable connector 10 and the separation of the flexible cable 20 and the cable connector 10, respectively, according to the second embodiment of the present disclosure. The second embodiment is the same as the first embodiment in that, as illustrated in FIG. 5 for the first embodiment, the push-pull device 12 includes a first engaged component 128 as well, and the push-pull device 12 is assembled in the shell 18 when the first engaged component 128 is fixed to the first embedded component 180. When the push-pull device 12 is pulled out in an A direction, the flexible cable 20 can be completely separated from the shell 18, and the flexible cable 20 is fixed to the push-pull device 12 only through the protrusive structure 202 so that the flexible cable 20 can be easily replaced. As FIG. 6 illustrates, the push-pull device 12 is completely withdrawn, and the first engaged component 128 can also be fixed to the second embedded component 182 as what is done in the first embodiment. The push-pull device 12 is partially arranged outside the shell 18. The separated push-pull device 12 can be pushed into the shell 18 in the B direction as well. The conductor 200 of the flexible cable 20 can further be connected to the terminal 16. The removable flexible cable 20 is also adopted by the second embodiment. Compared with the cable connector of the related art, the cost of the circuit board is saved, and the assembly procedure simplifies the manufacturing process and reduces the cost with practicality. Further, as illustrated in FIG. 6, the push-pull device 12 and the flexible cable 20 can be easily removed and replaced with the desired flexible cable 20.

Figure 8:
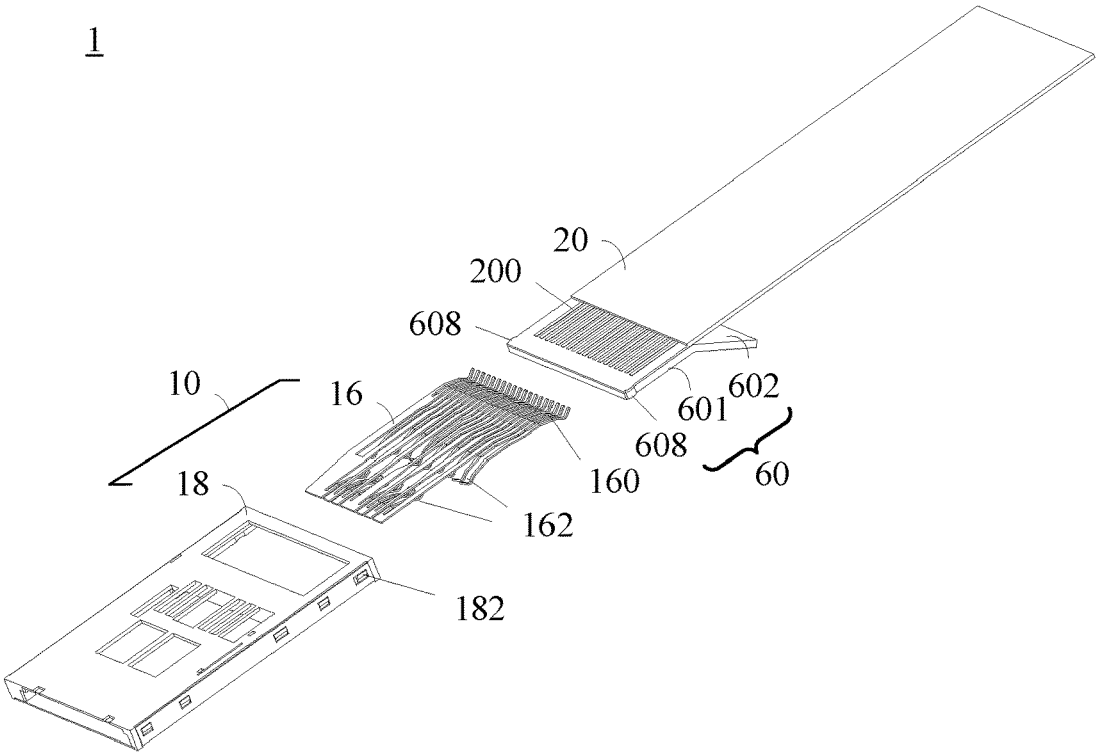
FIG. 8 illustrates an exploded diagram of a fixing assembly of a cable connector and a flexible cable according to a third embodiment of the present disclosure.

Please refer to FIG. 8 illustrating an exploded diagram of a fixing assembly 1 of a cable connector and a flexible cable according to a third embodiment of the present disclosure. The cable connector and the flexible cable 1 includes a cable connector 10, a flexible flat cable (FFC) 20, and a compressor 60. The cable connector 10 includes a terminal 16 and a shell 18. The terminal 16 includes a connecting portion 160 and a terminal portion 162 and is fixed in the shell 18. The compressor 60 is disposed on one side of the flexible cable 20 for compressing the flexible cable 20 when the flexible cable 20 is inserted into the cable connector 10, so that a conductive line 22 of the flexible cable 20 is in closer contact with the terminal 16. The compressor 60 includes a compressing plate 601, a protrusive plate 602, and a second engaged component 608. When the flexible cable 20 is pushed into a direction to the cable connector 10, the compressing plate 601 brings a conductor 200 is connected to the connecting portion 160 of the terminal 16 with the compressing plate 601.

Figure 9A:
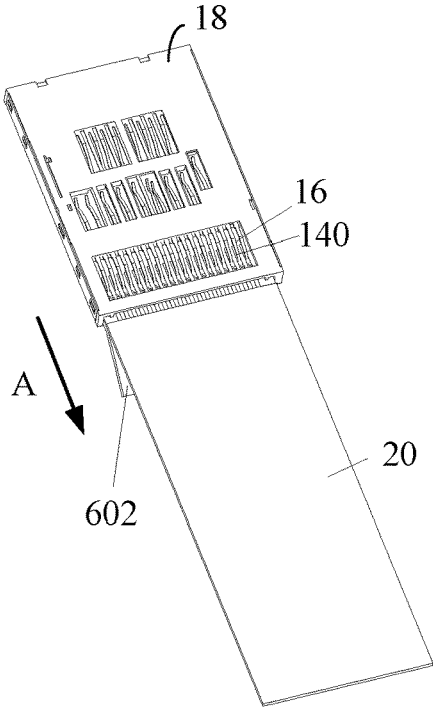
FIG. 9A is a diagram illustrating an assembly of the flexible cable and the cable connector according to the third embodiment of the present disclosure.
Figure 9B:
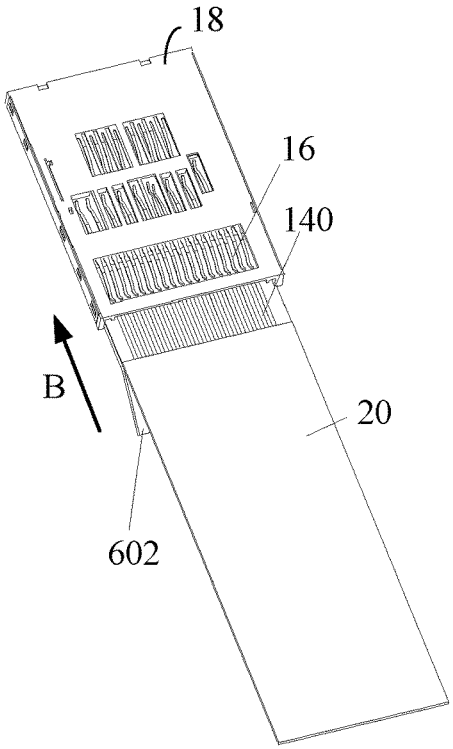
FIG. 9B is a diagram illustrating a separation of the flexible cable and the cable connector according to the third embodiment of the present disclosure.

Please refer to FIG. 9A and FIG. 9B illustrating schematic diagrams of the assembly of the flexible cable 20 and the cable connector 10 and the separation of the flexible cable 20 and the cable connector 10, respectively, according to the third embodiment of the present disclosure. The compressor 60 includes the protrusive plate 602 so the flexible cable 20 can be inserted and removed many times by imposing force on the protrusive plate 602, thereby avoiding directly pulling of the flexible cable 20 from short circuit or deformation. At the same time, the compressor 60 can press the flexible cable 20 in a direction to the terminal 16 so that the flexible cable 20 can be more closely connected to the terminal 16. The force imposed on the protrusive plate 602 renders the second engaged component 608 fixed to the first embedded component 180 of the shell 18 and makes the conductor 200 electrically contacted with the terminal 16. The structure and position of the second engaged component 608 and the shell 18 refers to the schematic diagram of the first engaged component 128 and the shell 18 in FIG. 5. By withdrawing the flexible cable 20 along the A direction, the flexible cable 20 can be separated from the cable connector 10, and the second engaged component 608 can be fixed to the second embedded component 182 to render the flexible cable 20 connected to the shell 18 while the conductor 200 does not contact the terminal 16. In this way, the cost and time of manufacturing and assembling the push-pull device and the circuit board is saved owing to the use of the cable connector 10. The advantage of flexibly inserting and removing the flexible cable 20 is kept as well. The third embodiment of the present disclosure works.

Figure 10:
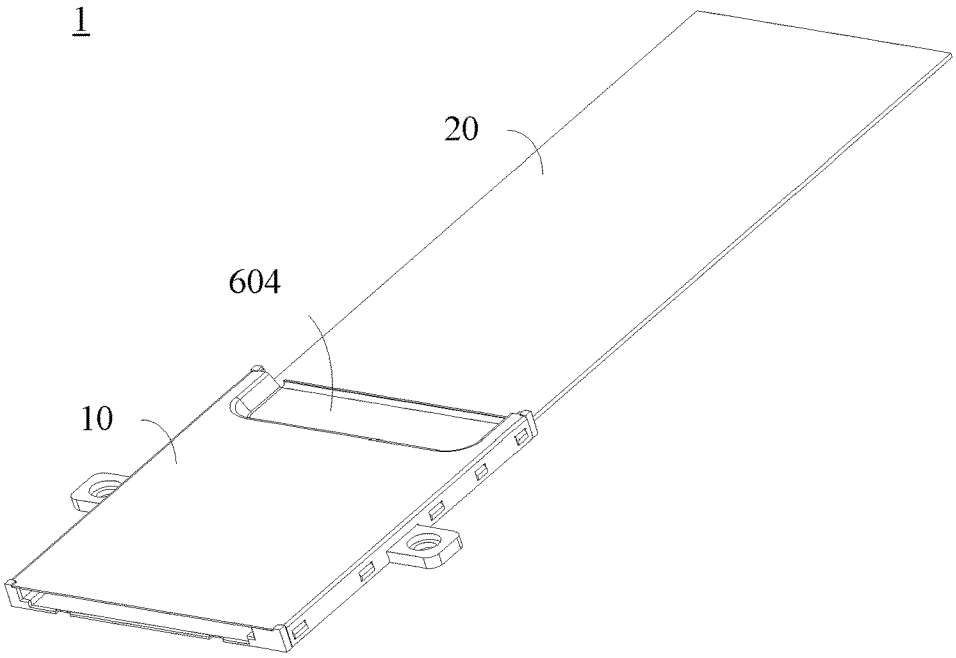
FIG. 10 illustrates a compressing device acting as a bending portion arranged on a shell according to a fourth embodiment of the present disclosure.
Figure 11:
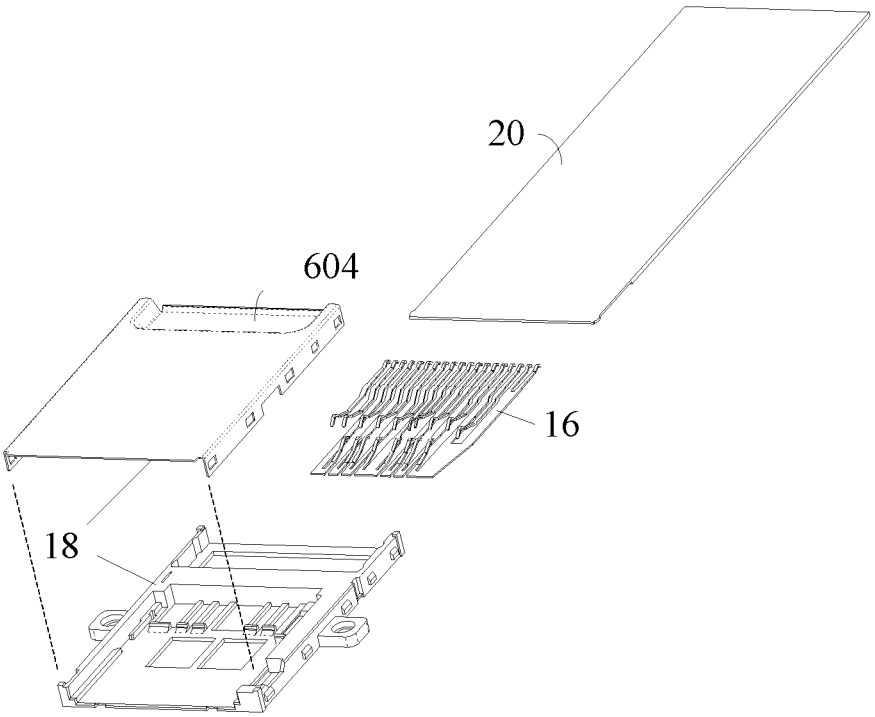
FIG. 11 illustrates an exploded view of the compressing device illustrated in FIG. 10.

Please refer to FIG. 10 illustrating a compressing device acting as a bending portion 604 arranged on a shell 18 according to a fourth embodiment of the present disclosure. The bending portion 604 is arranged on one side of the connecting portion with respect to the terminal 16 and a flexible flat cable (FFC) (i.e., a back surface of the shell 18) to prevent the external force or the bending portion from damaging the terminal 16 or the connected portion. Please refer to FIG. 11 as well. The bending portion 604 is arranged on one side of the shell 18, and the side is adjacent to the flexible cable 20. The bending portion 604 is formed before the shell 18 is formed. Or possibly, the bending portion 604 is formed after the cable connector 10 is connected to the flexible cable 20 and then force is imposed on the shell 18. The bending portion 604 is configured to render the flexible cable 20 and the shell 18 firmly contacted and the terminal 16 more firmly connected to the conductor 200, which helps avoid getting loose or short circuit because of shaking of the flexible cable 20.

Figure 12:
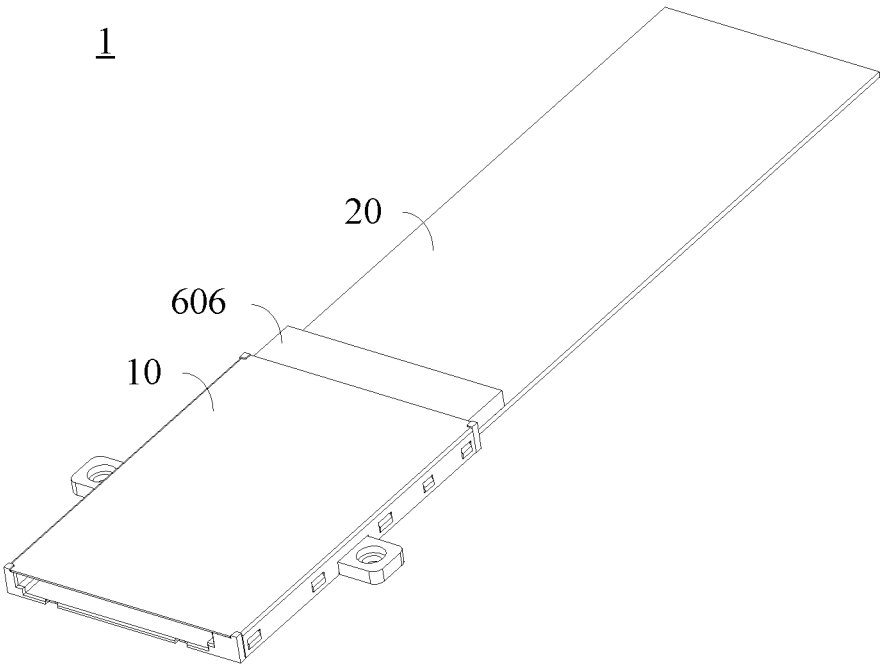
FIG. 12 illustrates a stereogram of a cable connector and a flexible cable according to a fifth embodiment of the present disclosure.
Figure 13A:
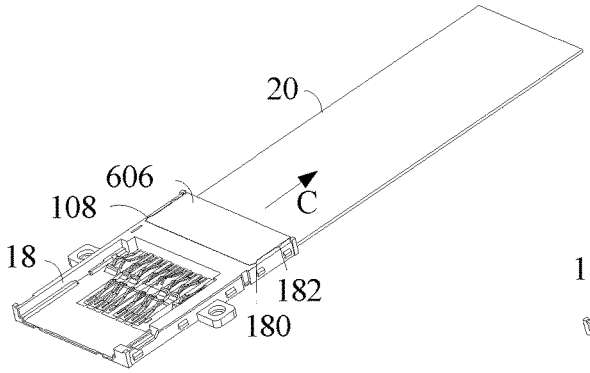
FIGS. 13A and 13B illustrate different views of a shell with respect to the positioning bump shown in FIG. 12.
Figure 13B:
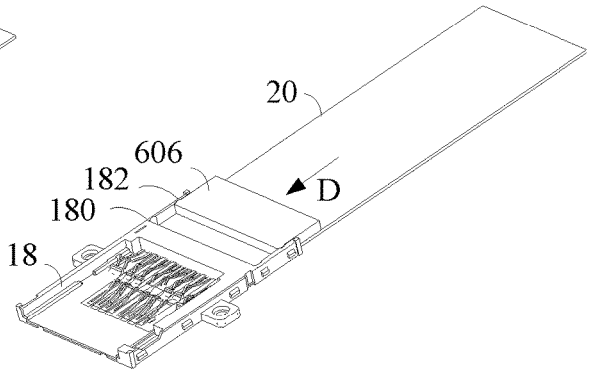

Please refer to FIG. 12 illustrating a stereogram of a cable connector 10 and a flexible cable 20 according to a fifth embodiment of the present disclosure. A compressing device in the fifth embodiment acts as an engaged bump 606. The engaged bump 606 is inserted into a gap among the terminals 16, the flexible cable 20, and the shell 18 to render the flexible cable 20 and the shell 18 firmly contacted while making the terminal 16 and the conductor 200 more securely connected. Please refer to FIGS. 13A and 13B as well. The engaged bump 606 may include a third engaged component 108 thereon and be embedded with a first embedded component 180 and a second embedded component 182 both arranged on the shell 18. The engaged bump 606 may be fixed to the first embedded component 180 with the third engaged component 108 as illustrated in FIG. 13A so as to assemble the engaged bump 606 to the shell 18 and arrange the engaged bump 606 in the shell 18. Alternatively, the engaged bump 606 is pulled out along a direction C to make the third engaged component 108 fixed to the second embedded component 182 so that the engaged bump 606 can protrude from the shell 18. The engaged bump 606 protruding from the shell 18 can be pushed in a D direction again. With the structure of the engaged bump 606 and the shell 18, the engaged bump 606 can be easily assembled onto the cable connector 10, which renders the terminals 16 and the flexible cable 20 to be tightly connected.

Figure 14:
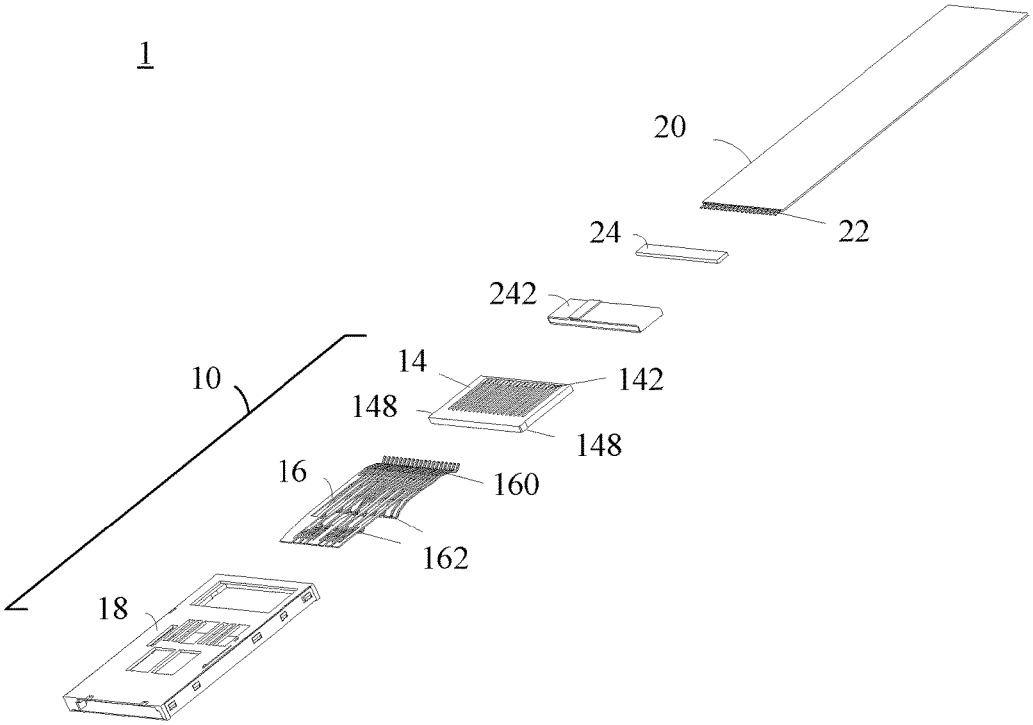
FIG. 14 illustrates an exploded diagram of a fixing assembly of a cable connector and a flexible cable according to a sixth embodiment of the present disclosure.

Please refer to FIG. 14 illustrating a cable connector 10 according to a sixth embodiment of the present disclosure. In the sixth embodiment, the cable connector 10 includes a circuit board 14, a terminal 16, and a shell 18. The circuit board 14 includes a conductive part 142 thereon. A flexible flat cable (FFC) 20 includes a plurality of conductors 22 thereon. The cable connector 10 is also configured to connect the flexible cable 20. A secure digital (SD) card can be inserted into the cable connector 10. In this embodiment, the conductive part 142 on the circuit board is directly electrically connected to the conductor 22; that is, the conductor 22 is electrically connected to the conductive part 142 by soldering. A first insulating adhesive 24 and a protective cover 242 as introduced in the first embodiment can be placed at the same locations. The locations and the functions of the insulating adhesive 24 and the protective cover 242 introduced in the present embodiment are the same as those introduced in the first embodiment, and therefore the detail on the locations and the functions will be skipped.

Figure 15A:
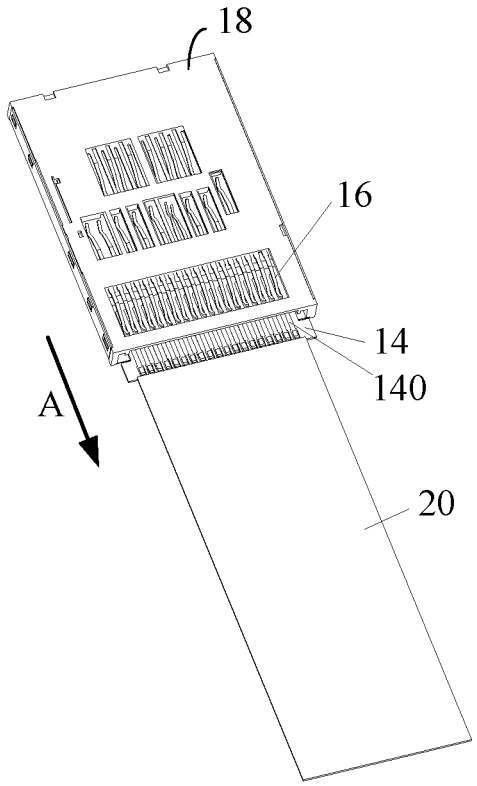
FIGS. 15A and 15B are schematic diagrams illustrating the connection and separation of the terminal and the circuit board illustrated in FIG. 14, respectively.
Figure 15B:
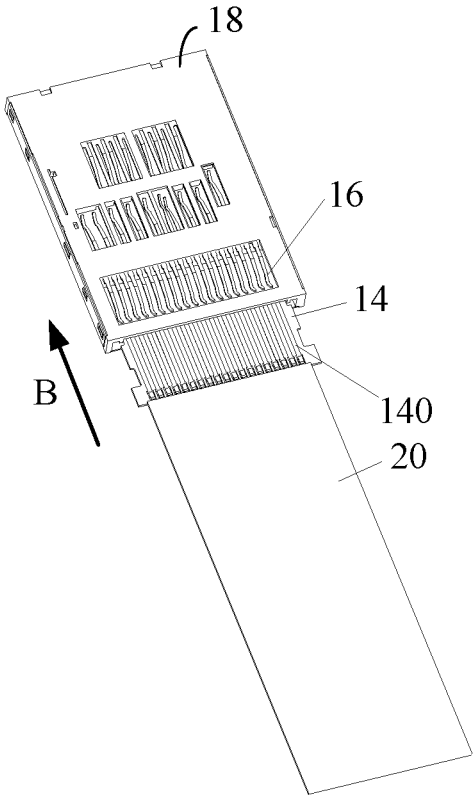

Please refer to FIGS. 15A and 15B. FIGS. 15A and 15B are schematic diagrams illustrating the connection and separation of the terminal and the circuit board illustrated in FIG. 14, respectively. When the circuit board 14 is arranged in the shell 18, the flexible cable 20 is electrically connected to the terminal 16 through the circuit board 14. The circuit board 14 can be withdrawn along an A direction, and the flexible cable 20 is not electrically connected to the terminal 16 at this time. The separated circuit board 14 can be pushed into the shell 18 along a B direction again to electrically connect the FFC to the terminal 16. The circuit board 14 can also include a fourth engaged component 148 (see FIG. 14) for securing the circuit board to the first mating component embedded component 180 or the second mating component 182 of the shell 18. In addition to the removable flexible cable 20, the cable connector 10 saves the sixth embodiment the manufacturing cost and assembly cost of the push-pull device are both compared with the cable connector of the related art.

Figure 16:
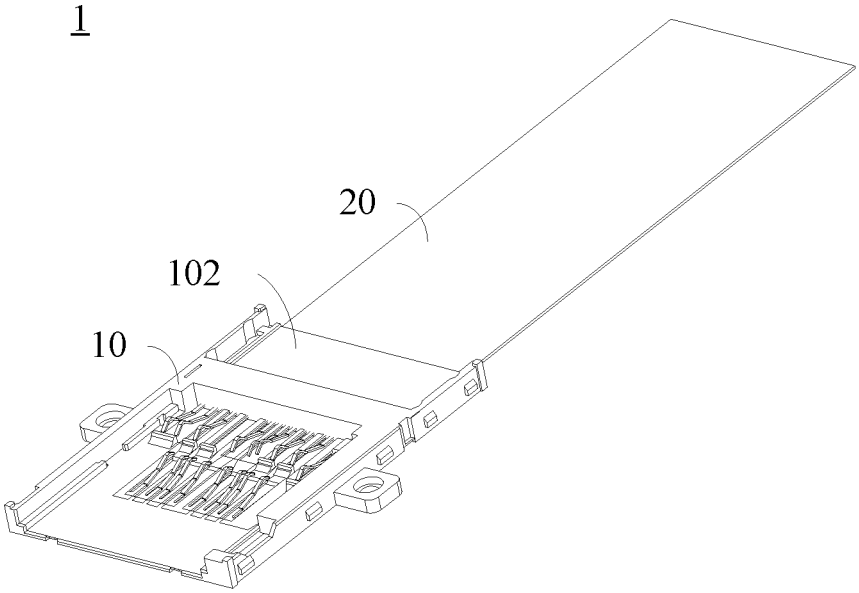
FIG. 16 is a stereogram illustrating a fixing assembly of a cable connector and a flexible cable according to a seventh embodiment of the present disclosure.
Figure 17:
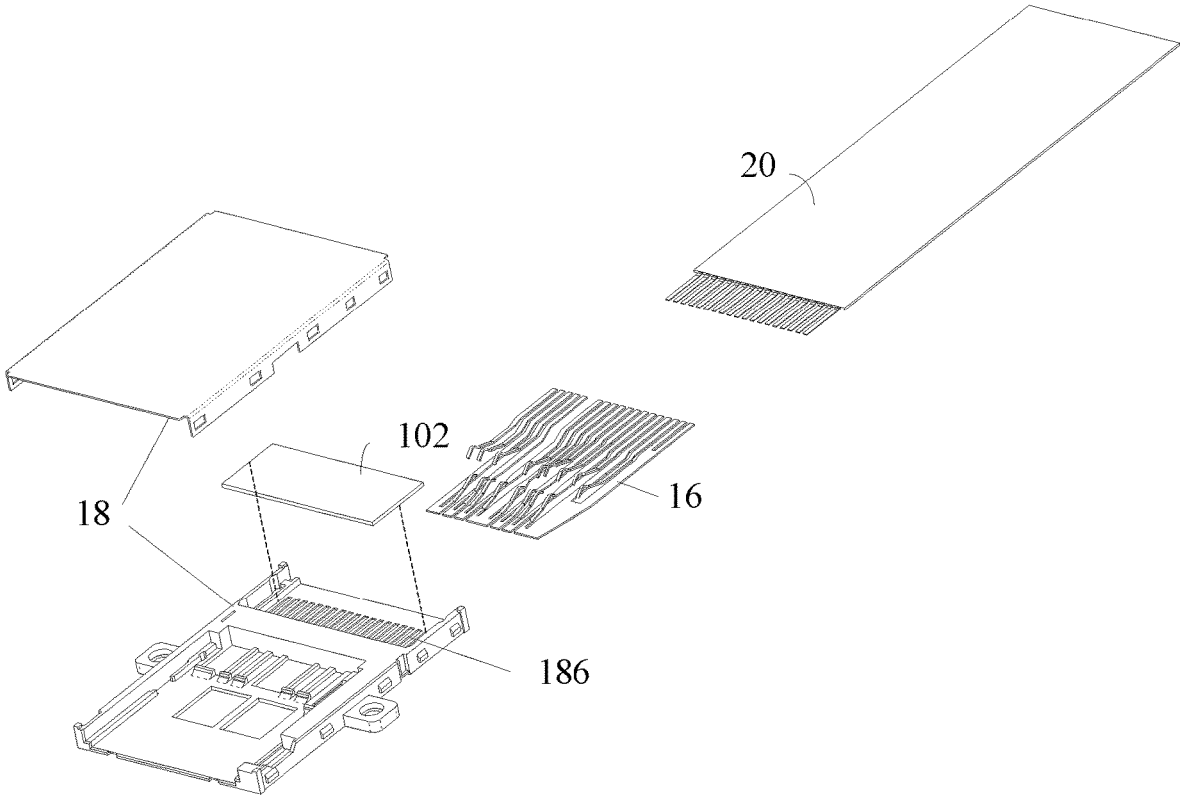
FIG. 17 is an exploded diagram illustrating the fixing assembly of the cable connector and the flexible cable according to the seventh embodiment of the present disclosure.

Please refer to FIG. 16 and FIG. 17. FIG. 16 is a stereogram illustrating a fixing assembly of a cable connector and a flexible cable 20 according to a seventh embodiment of the present disclosure. FIG. 17 is an exploded diagram illustrating the fixing assembly of the cable connector and the flexible cable 20 according to the seventh embodiment of the present disclosure. A portion of the shell 18 is not illustrated in FIG. 16 so as to introduce the location of a second insulating paste 102. The shell 18 may include a soldering portion 186 thereon to secure the flexible cable 20 to the cable connector 10. For example, the soldering portion 186 is paved with solder in advance by means of hot-melt soldering to fix the flexible cable 20 to the cable connector 10. The gap between the flexible cable 20 and the shell 18 is filled up with the second insulating adhesive 102 to protect the portion where the terminal 16 is connected to the flexible cable 20. The gap may result in disconnection or poor connection between the terminal 16 and the flexible cable 20, which affects the quality of signal transmission.

Figure 18A:
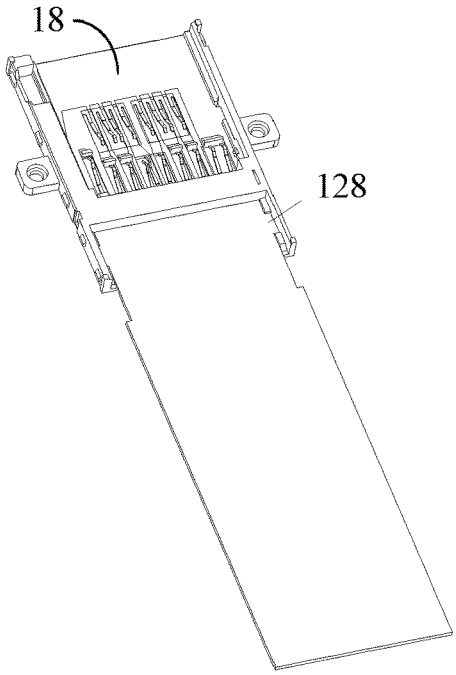
FIG. 18A is a diagram illustrating an assembly of the flexible cable and the cable connector according to the eighth embodiment of the present disclosure.
Figure 18B:
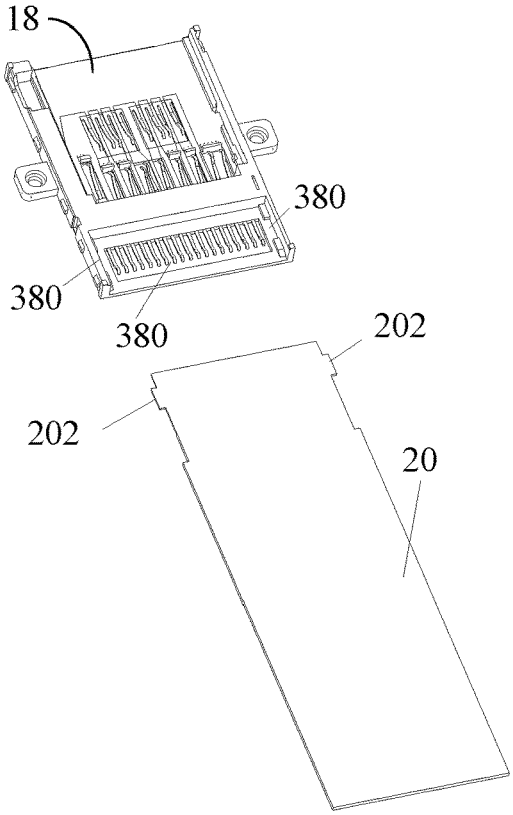
FIG. 18B is a diagram illustrating a separation of the flexible cable and the cable connector according to the eighth embodiment of the present disclosure.

Please refer to FIG. 18A and FIG. 18B. FIG. 18A and FIG. 18B are schematic diagrams illustrating the assembly of a flexible cable 20 and a cable connector 10 and the separation of the flexible cable 20 and the cable connector 10, respectively, according to an eighth embodiment of the present disclosure. For the sake of understanding, a portion of a shell 18 is not illustrated in FIGS. 18A and 18B. A conductor of the flexible cable 20 is directly soldered onto a terminal 16. A protrusive structure 202 of the flexible cable 20 may be rectangular, semi-circular, or semi-elliptical. An embedded component 380 of the shell 18 is a groove embedded with the protrusive structure 202.

Figure 19:
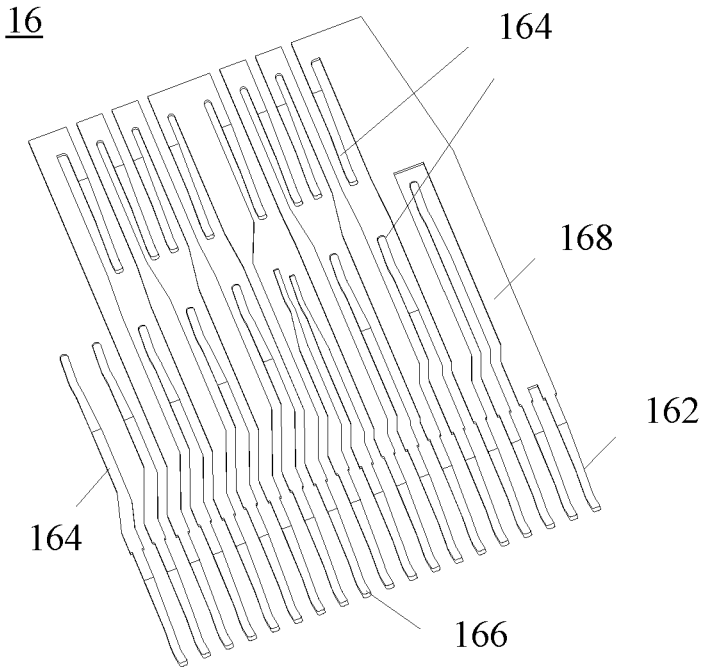
FIG. 19 illustrates a structural diagram of the terminal of the present disclosure.

Please refer to FIG. 19 illustrating a structural diagram of the terminal 16 of the present disclosure. To simplify the structure of a secure digital (SD) card connector, the terminal 16 includes a one-to-one terminal 164, a pair of two terminals 166, and a many-to-one terminal 168. The one-to-one terminal 164 is a structure in which a connecting portion 160 corresponds to a terminal portion 162. The pair of two terminals 166 is a structure in which a connecting portion 160 corresponds to two terminal portions 162. The many-to-one terminal 168 is a structure in which a plurality of connecting portions 160 correspond to a terminal portion 162. In this way, the terminal 16 is directly electrically connected to the flexible cable 20 without passing through the circuit board, thereby simplifying the process of manufacturing the cable connector 10 and saving the manufacturing cost of the cable connector 10.

Although the cable connector 10 introduced in each of the third, fourth, and fifth embodiments includes the terminal 16 and the shell 18, it is merely an example and is not intended to limit the present disclosure. The device 10 introduced in the first, third, and sixth embodiments and the flexible cable 20 introduced in the first, third, and sixth embodiments utilize the compressing device introduced in the third, fourth, and fifth embodiments to achieve a more stable connection between the terminal 16 and the flexible cable 20, which are all within the scope of the present disclosure.

The flexible cable 20 of different types introduced in the first, second, third, fourth, fifth, sixth, and seventh embodiments is merely exemplary. The flexible cable 20 introduced in each of the embodiments may be a general flex cable, a flex flat cable (FFC), or any transmission line structure that can be applied to the cable connector 10 of the present disclosure.

In the present disclosure, the first embedded component 180 and the second embedded component 182 are grooves, and the first engaged component 128, the second engaged component 608, the third engaged component 108, and the fourth engaged component 148 are bumps, which is merely exemplary instead of a limitation to the disclosure. Another example is that the first embedded component 180 and the second embedded component 182 are both embedded with the first engaged component 128, the second engaged component 608, and the third engaged component 108, and the fourth engaged component 148, which is within the scope of the present disclosure. For example, the first embedded component 180 and the second embedded component 182 are protrusion in structure. And the first engaged component 128, the second engaged component 608, the third engaged component 108, and the fourth engaged component 148 are all grooves. Another example is that the first engaged member 180 and the second embedded component 182 are rectangular grooves. And the first engaged component 128, the second engaged component 608, the third engaged component 108, and the fourth engaged component 148 all may be rectangular bump in structure that is embedded with the first embedded component 180 and the second embedded component 182.

The first insulating adhesive 24 and the second insulating adhesive 102 may be made from ultraviolet (UV) adhesive. The protective cover 242 may be made from acetate cloth. The engaged bump 606 may be made from insulating material such as resin or plastic in the present disclosure. However, this is only an example and is not intended to limit the disclosure. Any material that can achieve insulation and protection effects is within the scope of the present disclosure.

Through the fixing assembly of the cable connector and the FFC proposed by the present disclosure, the FFC can be inserted or replaced as needed. In addition, the soldering operation is facilitated; the manufacturing cost is saved; the assembly steps are simplified. The fixing assembly of the cable connector and the FFC is stabilized as well so that the FFC can be firmly connected to the cable connector to improve the problems of the related art.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A fixing assembly of a cable connector and a flexible cable, comprising:

the flexible cable, comprising a plurality of conductors; and the cable connector, comprising:

a shell;

a plurality of terminals, arranged in the shell; and a compressing device, configured to compress the flexible cable so as to contact the plurality of conductors and the plurality of terminals tightly, and render the flexible cable and the shell firmly contacted;

wherein the plurality of terminals are terminals that conform to at least one secure digital (SD) specification.

2. The fixing assembly of claim 1, wherein the flexible cable comprises an insulating coat; the compressing device is arranged in the insulating coat; the insulating coat comprises a protrusive plate; the compressing device is configured to impose force on the protrusive plate to activate the flexible cable to move toward the plurality of terminals or to impose force on the protrusive plate to activate the flexible cable to move away from the plurality of terminals into another direction.

3. The fixing assembly of claim 1, wherein the compressing device comprises an engaged bump; the shell comprises a first embedded component; the engaged bump of the compressing device is embedded into the first embedded component after the compressing device moves towards the plurality of terminals.

4. The fixing assembly of claim 3, wherein the shell further comprises a second embedded component; the first embedded component is closer to a center of the plurality of terminals than the second embedded component; the engaged bump of the compressing device is embedded into the second embedded component after the compressing device moves away from the plurality of terminals into another direction.

5. The fixing assembly of claim 1, wherein the compressing device acts as a bending portion of the shell; the bending portion is formed after the shell bends inward to form a compressing side to compress the flexible cable.

* * * * *